US006753655B2

(12) United States Patent
Shih et al.

(10) Patent No.: US 6,753,655 B2
(45) Date of Patent: Jun. 22, 2004

(54) PIXEL STRUCTURE FOR AN ACTIVE MATRIX OLED

(75) Inventors: Jun-Ren Shih, Changhua (TW); Shang-Li Chen, Hsinchu (TW); Chien-Ru Chen, Pingtung (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 10/330,247

(22) Filed: Dec. 30, 2002

(65) Prior Publication Data

US 2004/0056604 A1 Mar. 25, 2004

(30) Foreign Application Priority Data

Sep. 19, 2002 (TW) ..... 91121426 A

(51) Int. Cl.[7] ..... G09G 3/10
(52) U.S. Cl. ..... 315/169.3; 345/82; 345/92
(58) Field of Search ..... 315/169.2, 169.3; 345/211, 55, 76, 80, 82, 92

(56) References Cited

U.S. PATENT DOCUMENTS 6,580,408 B1 * 6/2003 Bae et al. ..... 345/76
2002/0195964 A1 * 12/2002 Yumoto ..... 315/169.3
2003/0020413 A1 * 1/2003 Oomura ..... 315/169.3
2003/0098829 A1 * 5/2003 Chen et al. ..... 345/82
2003/0179164 A1 * 9/2003 Shin et al. ..... 345/76

* cited by examiner

*Primary Examiner*—Wilson Lee
*Assistant Examiner*—Thuy Vinh Tran
(74) *Attorney, Agent, or Firm*—Birch, Stewart, Kolasch & Birch LLP

(57) ABSTRACT

A pixel structure for an active matrix OLED. A first switching transistor has a control terminal coupled to a first scan line, and a first terminal coupled to a data line. A first P-type transistor has a drain and a gate coupled to each other, and a source coupled to a voltage source. The drain is also coupled to a second terminal of the first switching transistor. A second P-type transistor has a source coupled to the voltage source, and a second switching transistor has two terminals coupled between gates of the first and second P-type transistors, and a control terminal coupled to a second scan line. A storage capacitor is coupled between the voltage source and the gate of the second P-type transistor. An OLED has an anode coupled to the drain of the second P-type transistor and a cathode coupled to ground.

19 Claims, 6 Drawing Sheets

PIXEL STRUCTURE FOR AN ACTIVE MATRIX OLED

This nonprovisional application claims priority under 35 U.S.C. § 119(a) on patent application Ser. No. 091121426 filed in TAIWAN on Sep. 19, 2002, which is herein incorporated by reference.

BACKGROUND OF THE INVENTION

1. Field of the Invention

The invention relates to a pixel structure, and more particularly to a current programmed pixel structure for an active matrix organic light emitting diode.

2. Description of the Related Art

Generally, in an active matrix display, images are displayed by numerous pixels in the matrix, and brightness of each pixel is controlled according to brightness data.

FIG. 1 show a conventional pixel structure 10 for an active matrix organic light emitting diode (AMOLED). The transistor $T_1$ is turned on when the scan line is activated in the programming state, and the data line sinks or supplies current for the specific driving transistor $T_2$. Meanwhile, gate-source voltage of the transistor $T_2$ is adjusted and stored in the storage capacitor $C_1$. In the next state while the scan line is deactivated, often called the reproduction state, the transistor $T_1$ is turned off and the transistor $T_2$ is electrically separated from the data line. The gate-source voltage stored in the storage capacitor $C_1$ may reproduce the current for the OLED, which illuminates accordingly. Threshold voltage of each driving transistor $T_2$ in the conventional pixel structure, however, deviates due to process variation, and this deviation may result in great variation of the output driving current through OLEDs, such that the brightness of each OLED is discordant and there is lack of uniformity in the OLEDs.

Therefore, the improved pixel structure 20 shown in FIG. 2 is promoted. Transistors $T_3$ and $T_4$ are turned on when the scan lines SCAN1 and SCAN2 are activated in the programming state, and the data line sinks or supplies current through the transistor $T_5$, such that the driving current may flow through the OLED and the storage capacitor $C_2$ is charged or discharged due to the current mirror structure composed of transistors $T_5$ and $T_6$. In the reproduction state, the transistors $T_3$ and $T_4$ are turned off when the scan lines SCAN1 and SCAN2 are deactivated, such that the transistor $T_6$ is electrically separated from the data line, and the gate-source voltage of the transistor $T_5$ is stored by the storage capacitor $C_2$. Based on this structure, the current through transistor $T_5$ is $$\frac{I_{OLED}}{I_5} = \frac{(W_6 \times L_5)}{(W_5 \times L_6)},$$

Therefore $$I_{OLED} = I_5 \times \frac{(W_6 \times L_5)}{(W_5 \times L_6)}$$

and then the driving current flowing into the OLED is $$I_5 = k(Vgs - Vt)^2 \times \frac{W_5}{L_5}, \text{ and}$$

-continued $$I_{OLED} = k(Vgs - Vt)^2 \times \frac{W_6}{L_6}, \text{ wherein } k = \frac{\mu Cox}{2}$$

Thus, the driving current flows into the OLED according to sizes of the transistors $T_5$ and $T_6$, and regardless of threshold voltage and process variation of the transistors.

In the current programming pixel structure 20, the voltage on the drain terminal of the transistor $T_5$, however, is increased to VDD when the scan line is deactivated, such that this voltage of the transistor $T_5$ is coupled to the storage capacitor $C_2$ by the parasitical capacitor between the gate terminal and drain terminal. Therefore, this deviation may still result in variation of the output driving current through OLEDs.

SUMMARY OF THE INVENTION

The present invention is directed to a current programmed AMOLED pixel structure capable of providing current to OLEDs stably and precisely, regardless of process variation.

The present invention is also directed to a current programmed AMOLED pixel structure capable of improving switching effect caused by switching transistors, thereby increasing reliability.

In the present invention, a first switching transistor has a control terminal coupled to a first scan line, and a first terminal coupled to a data line. A first P-type transistor has a drain terminal and a gate terminal coupled to each other, and a source terminal coupled to a voltage source, and the drain terminal is also coupled to a second terminal of the first switching transistor. A second switching transistor has a first terminal coupled to the gate terminal of the first P-type transistor, and a control terminal coupled to a second scan line. A second P-type transistor has a source terminal coupled to the voltage source, and a gate terminal coupled to a second terminal of the second switching transistor. A storage capacitor is coupled between the voltage source and the gate terminal of the second P-type transistor. An OLED has an anode coupled to the drain terminal of the second P-type transistor and a cathode coupled to ground.

DESCRIPTION OF THE DRAWINGS

For a better understanding of the present invention, reference is made to a detailed description to be read in conjunction with the accompanying drawings, in which.

DETAILED DESCRIPTION OF THE INVENTION

Figure 1:
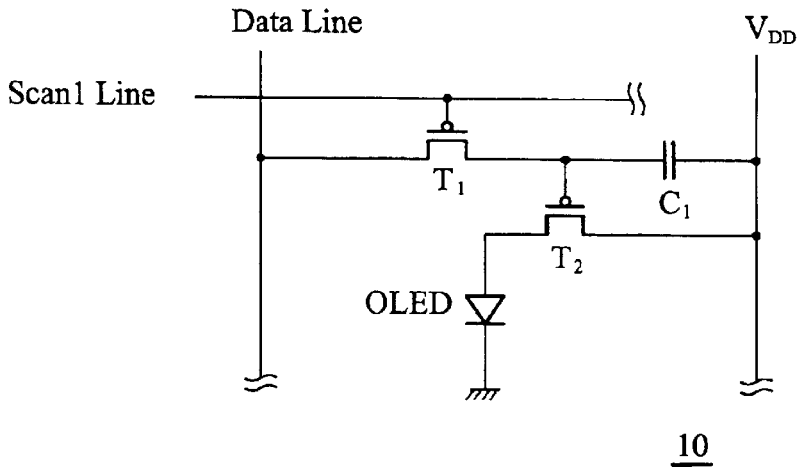
FIG. 1 ( PRIOR ART )
FIG. 1 is a conventional pixel structure for AMOLED.
Figure 2:
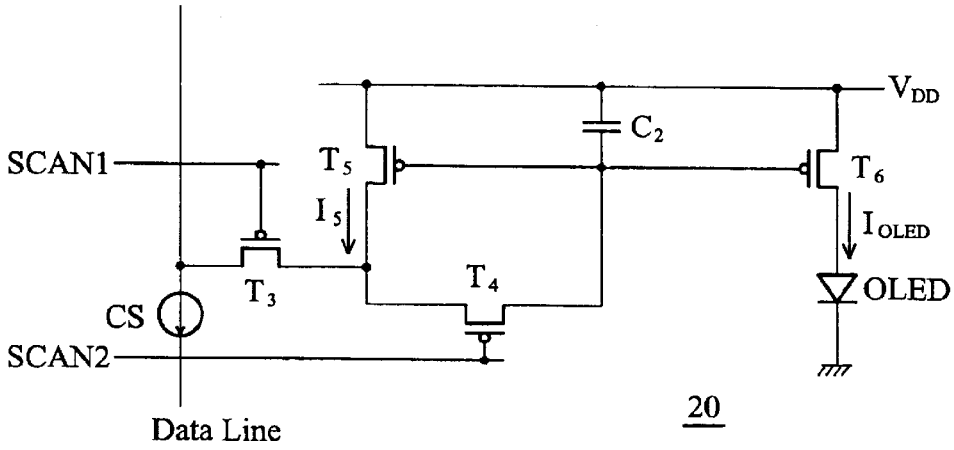
FIG. 2 ( PRIOR ART )
FIG. 2 is another conventional pixel structure for AMOLED.
Figure 3:
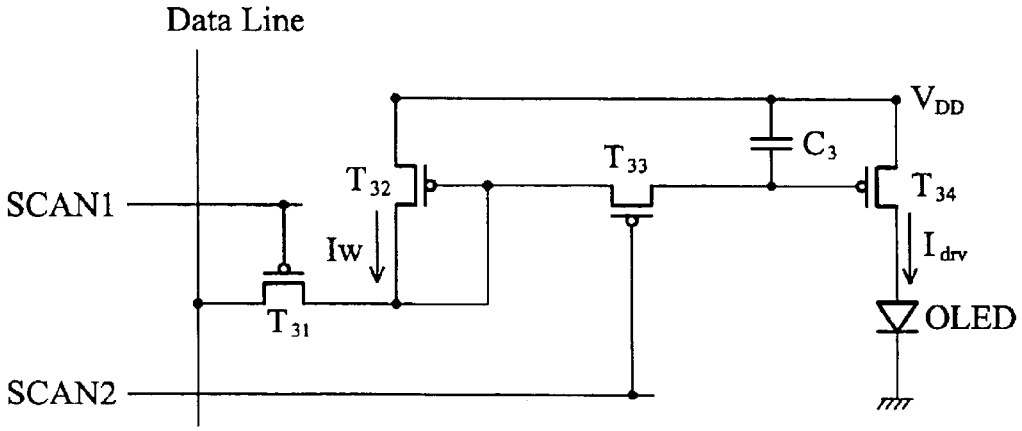
FIG. 3 shows a pixel structure for AMOLED according to the present invention.

FIG. 3 shows a pixel structure for AMOLED according to the present invention. As shown in FIG. 3, a switching transistor $T_{31}$ has a first terminal coupled to a data line, and a control terminal coupled to a scan line SCAN1. A transistor $T_{32}$ has a drain terminal coupled to the source terminal thereof, and to a second terminal of the switching transistor $T_{31}$, and a source terminal coupled to a voltage source VDD. A switching transistor $T_{33}$ has a first terminal coupled to the gate terminal of the transistor $T_{32}$, and a control terminal coupled to a second scan line SCAN2. A transistor $T_{34}$ has a source terminal coupled to the voltage source VDD, and a gate terminal coupled to a second terminal of the switching transistor $T_{33}$. A storage capacitor $C_3$ has two ends coupled between the voltage source VDD and the gate terminal of the transistor $T_{34}$. An organic light emitting diode OLED has an anode coupled to the drain terminal of the P-type transistor $T_{34}$ and a cathode coupled to ground.

The switching transistor $T_{31}$ controls the electrical connection between this pixel structure and the data line by the scan line SCAN1, and a current Iw flows through the transistor $T_{32}$. The switching transistor $T_{32}$ electrically connects the gate terminal of the transistor $T_{32}$ to the gate terminal of the transistor $T_{34}$ during the programming state. Transistor $T_{34}$ outputs corresponding driving current Idrv to the organic light emitting diode OLED according to the voltage stored in the storage capacitor $C_3$ on the gate terminal thereof.

The gate terminals of the transistors $T_{32}$ and $T_{34}$ are coupled to each other by the switching transistor $T_{33}$, such that a current mirror is constructed. Thus, the driving current Idrv is in proportion to the current Iw.

Figure 6A:
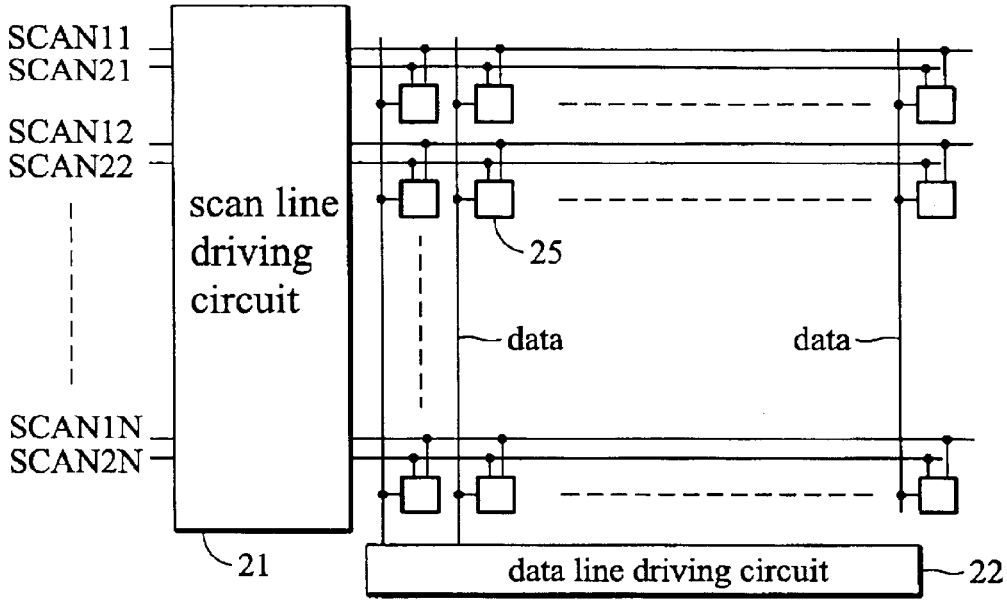
FIG. 6*a* shows a display device with AMOLED pixel structures as shown in FIG. 3 according to the present invention.

FIG. 6*a* shows a display device with AMOLED pixel structures as shown in FIG. 3 according to the present invention. A scan line driving circuit 21 activates scan lines continuously, and a data line driving circuit 22 with a current source provides current to the data lines according to the brightness data. A plurality of pixel structures 25 are positioned at intersections between two scans lines and one data line, and every pixel structure 25 is the same as structure shown in FIG. 3.

The driving method of the pixel structure according to the present invention follows. The transistors $T_{31}$ and $T_{33}$, first, are turned on when the scan lines SCAN1 and SCAN2 are in the programming state, such that a current Iw flows through the transistor $T_{32}$ due to the data line with current source, wherein the current source varies according to brightness data.

The scan line SCAN2 then is deactivated prior to the scan line SCAN1 during the reproduction state, such that transistor $T_{33}$ is turned off to electrically separate the transistor $T_{32}$ from the transistor $T_{34}$. Next, the scan line SCAN1 is deactivated to electrically separate this pixel structure from the data line. After that, the gate voltage on the transistor $T_{34}$ is stored in the storage capacitor $C_3$, and another pixel structure is programmed by the data line.

Figure 7:
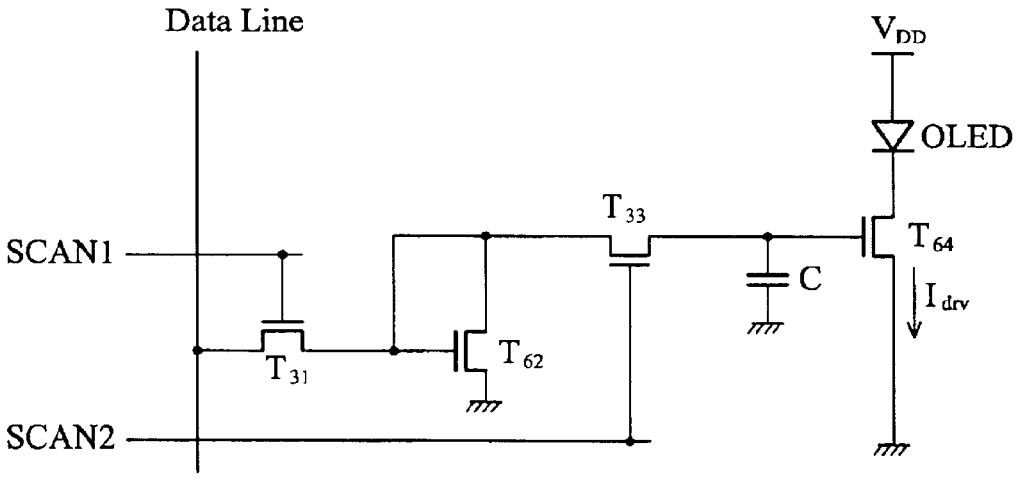
FIG. 7 shows another pixel structure for AMOLED according to the present invention.

Therefore, the driving current Idrv is in proportion to the current Iw, regardless of threshold voltage and process variation of the transistors because a current mirror is constructed when the gate terminals of the transistors $T_{32}$ and $T_{34}$ are coupled to each other by the switching transistor $T_{33}$ during the programming state. Though the drain-gate voltage is increased when the transistor $T_{31}$ is turned off, the transistor $T_{32}$ is electrically separated from the storage capacitor $C_3$ because the transistor $T_{33}$ is turned off prior to the transistor $T_{31}$, such that the voltage stored in the storage capacitor $C_3$ is less sensitive to the switching effects, also called feedthrough effect, caused by the transistor $T_{31}$. In addition, the switching transistors $T_{31}$ and $T_{33}$ and transistors $T_{32}$ and $T_{34}$ are p-type thin film transistors, but can also be replaced by N-type thin film transistors. As shown in FIG. 7, the transistors $T_{32}$ and $T_{34}$ are replaced by N-type thin film transistors $T_{62}$ and $T_{64}$, and the driving method thereof is the same as the pixel structure as shown in FIG. 3.

However, when the switching transistor $T_{33}$ switches according to the scan line SCAN2, the transistor $T_{33}$ still results in a feedthrough effect to couple to the storage capacitor $C_3$, such that the gate voltage of the transistor T34 may still suffer from the feedthrough effect, and the driving current is deviated from the current value programmed during the programming state.

Figure 4:
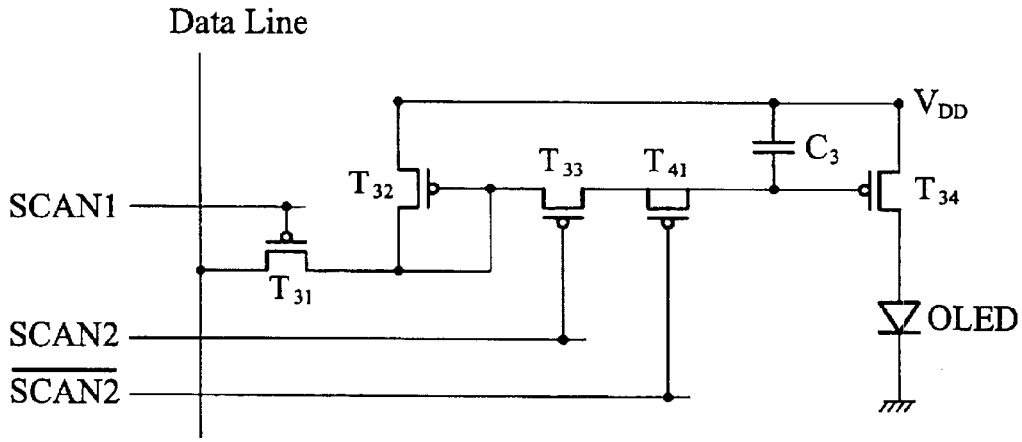
FIG. 4 shows another pixel structure for AMOLED according to the present invention.

To address this problem, another embodiment is proposed as follows. FIG.4 shows another pixel structure for AMOLED according to the present invention. For brevity, the elements in FIG. 4 the same as or similar with the elements in FIG. 3 are depicted by the same numerals or notations. As shown in FIG. 4, the pixel structure further has a capacitive element. In this case, this capacitive element is a dummy transistor $T_{41}$ with source terminal and drain terminal coupled to the second terminal of the transistor $T_{32}$ and the gate terminal of the transistor $T_{34}$ respectively, and a gate terminal coupled to a compensation scan line /SCAN2. The drain terminal and the source of the dummy transistor $T_{41}$ are coupled to each other, and the compensation scan line /SCAN2 is activated when the second scan line SCAN2 is deactivated, and the compensation scan line /SCAN2 is deactivated when the second scan line SCAN2 is activated. The size of the dummy transistor and the switching transistor $T_{31}$, sometime, is not equal, for example, the dummy transistor $T_{41}$ has half size of the switching transistor $T_{33}$.

Figure 6B:
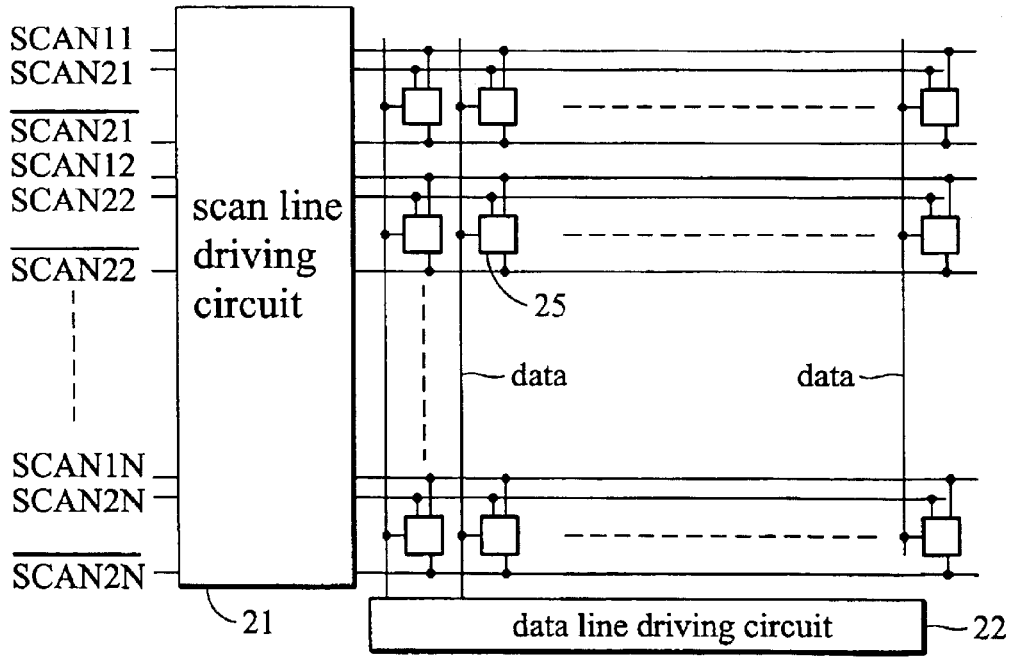
FIG. 6*b* shows another display device with AMOLED pixel structures as shown in FIGS. 4 and 5 according to the present invention.
Figure 8:
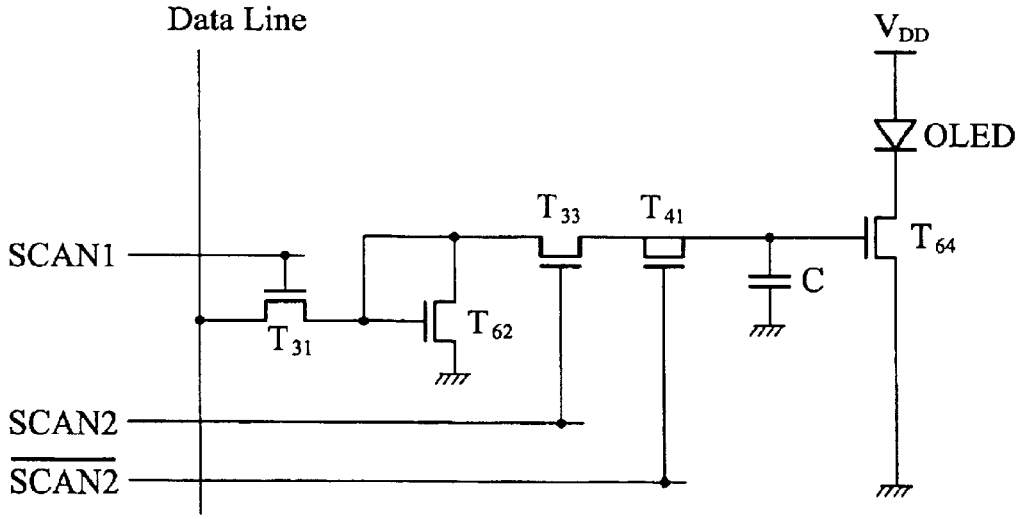
FIG. 8 shows another pixel structure for AMOLED according to the present invention.

The feedthrough effect caused by switching transistor $T_{33}$ is compensated for by the dummy transistor $T_{41}$. For example, the dummy transistor results in a reverse feedthrough effect to compensate for the feedthrough effect caused by transistor $T_{33}$ because compensation scan line /SCAN2 is activated when the second scan line SCAN2 is deactivated and the compensation scan /SCAN2 line is deactivated when the second scan line SCAN2 is activated, such that the voltage stored in the storage capacitor $C_3$ are less sensitive to the feedthrough effects caused by transistor $T_{33}$. In addition, the switching transistors $T_{31}$ and $T_{33}$ and transistors $T_{32}$ and $T_{34}$ are p-type thin film transistors, but can also be replaced by N-type thin film transistors. As shown in FIG. 8, the transistors $T_{32}$ and $T_{34}$ are replaced by N-type thin film transistors $T_{62}$ and $T_{64}$, and the driving method thereof is the same as the pixel structure as shown in FIG. 4. FIG. 6*b* shows a display device with AMOLED pixel structures as shown in FIG. 4 according to the present invention. A scan line driving circuit 21 activates scan lines continuously, and a data line driving circuit 22 with a current source provides current to the data lines according to the brightness data. A plurality of pixel structures 25 are positioned at intersections between two scans lines and one data line, and every pixel structure 25 is the same as pixel structure shown in FIG. 4.

Figure 5:
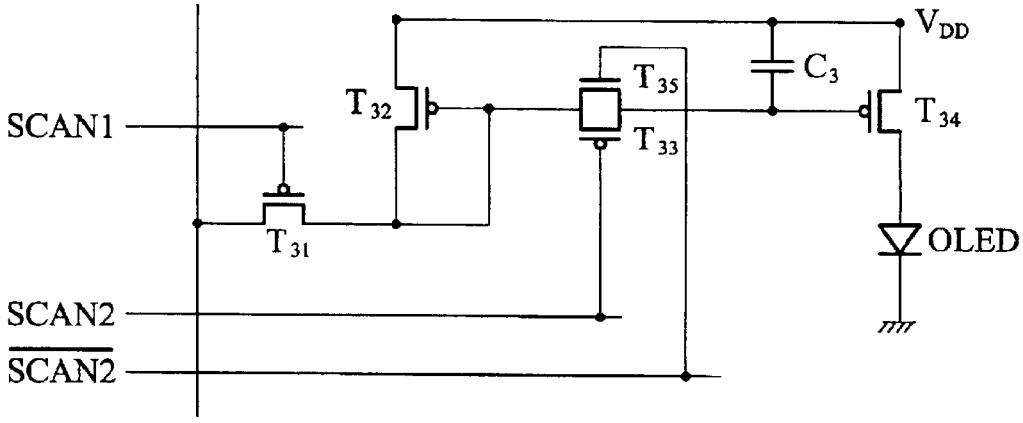
FIG. 5 shows another pixel structure for AMOLED according to the present invention.

Also, to address the feedthrough effect caused by the transistor $T_{33}$, another embodiment is proposed as follows. FIG. 5 shows another pixel structure for AMOLED according to the present invention. For brevity, the elements in FIG. 5 the same as or similar with the elements in FIG. 3 are depicted in the same numerals or notations. As shown in FIG. 5, the pixel structure further has a switch transistor $T_{35}$. This transistor $T_{35}$ has two terminals coupled to the first terminal and the second terminal of the switch transistor $T_{33}$ respectively to construct a CMOS switch device, and a gate terminal coupled to compensation scan line /SCAN2 wherein the compensation scan line /SCAN2 is activated when the second scan line SCAN2 is deactivated, and the compensation scan line /SCAN2 is deactivated when the second scan SCAN2 line is activated.

Figure 9:
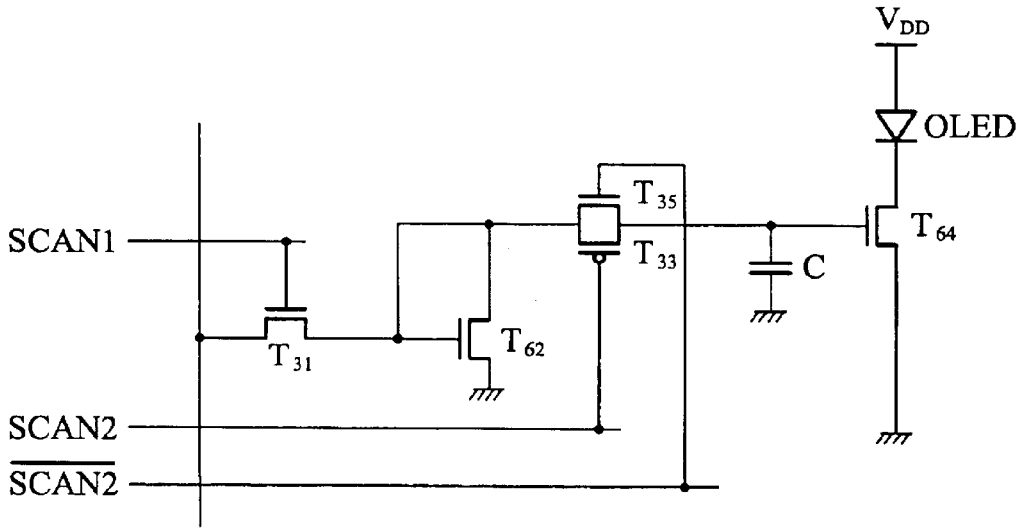
FIG. 9 shows another pixel structure for AMOLED according to the present invention.

The feedthrough effect caused by switching transistor $T_{33}$ is canceled by the switching transistor $T_{35}$. For example, if the switching transistor $T_{35}$ results in a reverse feedthrough effect to cancel the feedthrough effect caused by transistor $T_{33}$ because transistors $T_{35}$ and $T_{33}$ construct the CMOS switching device and are controlled by scan line SCAN2 and compensation scan line /SCAN2, such that the voltage stored in the storage capacitor $C_3$ is not sensitive to the feedthrough effects caused by transistor $T_{33}$. In addition, the switching transistors $T_{31}$ and $T_{33}$ and transistors $T_{32}$ and $T_{34}$ are p-type thin film transistors, but can also be replaced by N-type thin film transistors. As shown in FIG. 9, the transistors $T_{32}$ and $T_{34}$ are replaced by N-type thin film transistors $T_{62}$ and $T_{64}$, and the driving method thereof is the same as the pixel structure as shown in FIG. 5.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Thus, the scope of the appended claims should be accorded the broadest interpretation so as to encompass all such modifications and similar arrangements.

What is claimed is:

1. A pixel structure for an active matrix OLED, comprising:

a first switching device having a control terminal coupled to a first scan line and a first terminal coupled to a data line;

a first P-type transistor having a drain terminal and a gate terminal coupled to each other and a source terminal coupled to a voltage source, wherein the drain terminal of the first P-type transistor is coupled to a second terminal of the first switch transistor;

a second switching device having a first terminal coupled to the gate terminal of the first P-type transistor and a control terminal coupled to a second scan line;

a second P-type transistor having a source terminal coupled to the voltage source and a gate terminal coupled to a second terminal of the second switch transistor;

a storage capacitor coupled between the voltage source and the gate terminal of the second P-type transistor; and an OLED having an anode coupled to a drain terminal of the second P-type transistor, and a cathode coupled to ground.

2. The pixel structure of claim 1, further comprising:

a capacitive device having two terminals coupled between the second terminal of the second switching transistor and the gate terminal of the second P-type transistor, and a third terminal coupled to a compensation scan line, wherein the compensation scan line is activated when the second scan line is deactivated, and the compensation scan line is deactivated when the second scan line is activated.

3. The pixel structure of claim 2, wherein the capacitive device is a dummy transistor having a source terminal and a drain terminal coupled to a second terminal of the second switching transistor and the gate terminal of the second P-type transistor respectively, and a gate terminal coupled to the compensation scan line, wherein the source terminal and the drain terminal of the dummy transistor are coupled to each other.

4. The pixel structure of claim 3, wherein the dummy transistor is half the size of the second switching device.

5. The pixel structure of claim 1, further comprising:

a third switching transistor having two terminals coupled to the first terminal and the second terminal of the second switching transistor respectively, and a control terminal coupled to a compensation scan line, wherein the second and third switching transistors construct a CMOS switching device, and the compensation scan line is activated when the second scan line is deactivated and the compensation scan line is deactivated when the second scan line is activated.

6. The pixel structure of claim 5, wherein the third switching transistor is an N-type thin film transistor when the second transistor is a P-type thin film transistor.

7. The pixel structure of claim 5, wherein the third switching transistor is a P-type thin film transistor when the second transistor is an N-type thin film transistor.

8. The pixel structure of claim 1, wherein the first switching transistor is an N-type thin film transistor.

9. The pixel structure of claim 1, wherein the first switching transistor is an P-type thin film transistor.

10. The pixel structure of claim 1, wherein the second switching transistor is an N-type thin film transistor.

11. The pixel structure of claim 1, wherein the second switching transistor is a P-type thin film transistor.

12. The pixel structure of claim 1, wherein the first switching transistor is an N-type thin film transistor and the second switching transistor is a P-type thin film transistor.

13. The pixel structure of claim 1, wherein the first switch transistor is a P-type thin film transistor, and the second switching transistor is an N-type thin film transistor.

14. A pixel structure for an active matrix OLED, comprising:

a first switching device having a control terminal coupled to a first scan line and a first terminal coupled to a data line;

a first P-type transistor having a drain terminal and a gate terminal coupled to each other and a source terminal coupled to a voltage source, wherein the drain terminal of the first P-type transistor is coupled to a second terminal of the first switch transistor;

a second switching device having a first terminal coupled to a gate terminal of the first P-type transistor, and a control terminal coupled to a second scan line;

a second P-type transistor having a source terminal coupled to the voltage source;

a dummy transistor having a source terminal and a drain terminal coupled to a second terminal of the second switching transistor and the gate terminal of the second P-type transistor respectively, and a gate terminal coupled to a compensation scan line, wherein the source terminal and the drain terminal of the dummy transistor are coupled to each other, the dummy transistor is half the size of the second switching transistor, the compensation scan line is activated when the second scan line is deactivated and the compensation scan line is deactivated when the second scan line is activated;

a storage capacitor coupled between the voltage source and a gate terminal of the second P-type transistor; and an OLED having an anode coupled to a drain terminal of the second P-type transistor, and a cathode coupled to ground.

15. A pixel structure for an active matrix OLED, comprising:

a first switching device having a control terminal coupled to a first scan line and a first terminal coupled to a data line;

a first P-type transistor having a drain terminal and a gate terminal coupled to each other and a source terminal coupled to a voltage source, wherein the drain terminal of the first P-type transistor is coupled to a second terminal of the first switch transistor;

a second switching device having a first terminal coupled to a gate terminal of the first P-type transistor and a control terminal coupled to a second scan line;

a third switching transistor having two terminals coupled to the first terminal and the second terminal of the second switching transistor respectively, and a control terminal coupled to a compensation scan line, wherein the second and third switching transistors construct a CMOS switching device and the compensation scan line is activated when the second scan line is deactivated and the compensation scan line is deactivated when the second scan line is activated;

a second P-type transistor having a source terminal coupled to the voltage source and a gate terminal coupled to a second terminal of the second switch transistor;

a storage capacitor coupled between the voltage source and the gate terminal of the second P-type transistor; and an OLED having an anode coupled to a drain terminal of the second P-type transistor, and a cathode coupled to ground.

16. The pixel structure of claim 15, wherein the first switching transistor is an N-type thin film transistor.

17. The pixel structure of claim 15, wherein the first switching transistor is a P-type thin film transistor.

18. The pixel structure of claim 15, wherein the second switching transistor is an N-type thin film transistor and the third switching transistor is a P-type thin film transistor.

19. The pixel structure of claim 15, wherein the second switching transistor is a P-type thin film transistor and the third switching transistor is an N-type thin film transistor.

* * * * *